US006664933B2

(12) United States Patent
Spirtus

(10) Patent No.: US 6,664,933 B2
(45) **Date of Patent: *Dec. 16, 2003**

(54) MULTI-FEED REFLECTOR ANTENNA

(75) Inventor: Danny Spirtus, Holon (IL)

(73) Assignees: Gilat Satellite Networks, Ltd., Petah Tikva (IL); Spacemet Inc., McLean, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/329,575

(22) Filed: Dec. 27, 2002

(65) Prior Publication Data

US 2003/0090432 A1 May 15, 2003

Related U.S. Application Data

(63) Continuation of application No. 09/827,370, filed on Apr. 6, 2001.

(60) Provisional application No. 60/195,247, filed on Apr. 7, 2000.

(51) Int. Cl.[7] ..... H01Q 19/14

(52) U.S. Cl. ..... 343/840; 343/779; 343/781 R

(58) Field of Search ..... 343/840, 781 R, 343/781 P, 779; H01Q 19/14

(56) References Cited

U.S. PATENT DOCUMENTS 4,712,111 A 12/1987 Ohta et al.
5,309,167 A 5/1994 Cluniat et al.
5,434,586 A 7/1995 Kinoshita et al.
5,546,097 A 8/1996 Ramanujam et al.
5,673,056 A 9/1997 Ramanujam et al.
5,805,116 A 9/1998 Morley
5,859,620 A 1/1999 Skinner et al.
6,087,999 A 7/2000 Muhlhauser et al.
6,107,897 A 8/2000 Muhlhauser et al.
6,111,547 A 8/2000 Gau et al.
6,166,704 A 12/2000 Jan et al.
6,181,289 B1 1/2001 Matsui
6,208,312 B1 3/2001 Gould
6,215,452 B1 4/2001 Chandler et al.
6,215,453 B1 4/2001 Grenell
6,222,495 B1 4/2001 Cook
6,323,822 B2 11/2001 Cook et al.
6,373,445 B1 4/2002 Kuno
6,392,611 B1 5/2002 Smith et al.
6,445,907 B1 9/2002 Middeke et al.
6,535,176 B2 * 3/2003 Spirtus ..... 343/840

* cited by examiner

*Primary Examiner*—Hoanganh Le
(74) *Attorney, Agent, or Firm*—Banner & Witcoff Ltd.

(57) ABSTRACT

An antenna includes a reflector having a first axis, a second axis, a focal zone that is about parallel to the first axis, and a focal point located within the focal zone. A transmit feed is located at the focal point, and at least one receive feed is located within the focal zone. The transmit feed is part of a bidirectional feed that includes an integral receive feed. The bidirectional feed transmits and receives an RF signal carrying digital information signals to and from a first satellite, such as an FSS satellite, and each respective receive feed receives a signal from satellite, such as a DBS satellite.

6 Claims, 7 Drawing Sheets

MULTI-FEED REFLECTOR ANTENNA

CROSS REFERENCE OF RELATED APPLICATION

This application claims priority to provisional U.S. Application Ser. No. 60/195,247, filed Apr. 7, 2000 and a continuation of pending application Ser. No. 09/827,370, filed Apr. 6, 2001 herein incorporated by reference.

BACKGROUND OF THE INVENTION

The present invention relates to the field of satellite communications. More particularly, the present invention relates to a multi-feed antenna suitable for satellite communications.

Geostationary direct broadcast systems (DBS) are geostationary satellite systems that are direct competitors to terrestrially-based cable television systems. Such DBS systems have the advantage of allowing a terrestrially-based receiver to receive a plurality of television channels from virtually any location on Earth, while a cable television subscriber must be connected to a cable television system to receive television signals. Terrestrial-based cable television systems have the advantage over DBS systems of allowing a subscriber to have a high-bandwidth Internet connection through the cable television system, while such a connection is unavailable through a DBS system. Currently, digital links to the Internet are available through the fixed satellite system (FSS), another system of geostationary satellites.

U.S. Pat. No. 5,859,620 to Skinner et al. relates to a multiband feedhorn satellite receiving antenna that receives signals from more than 30 satellites that are longitudinally spaced in geosynchronous orbits above the equator of the Earth. According to Skinner et al., a satellite receiving antenna includes a torodial reflector having a circular cross-section in a horizontal (longitudinal or azimuthal) plane and a parabolic cross-section in an elevational plane. The size of the Skinner et al. reflector requires a plurality of braces for support and is far too large for use in a residential environment.

U.S. Pat. No. 5,805,116 to Morley discloses to an ultra-small aperture antenna for a satellite communications terminal having a dish reflector and separate transmit and receive feedhorns. According to Morley, a receive feedhorn is spatially offset from a transmit feedhorn. Both feedhorns are disposed within a focal point zone such that the receive feedhorn is positioned at an ideal focal point of the dish reflector. The transmit feedhorn is positioned to have an aperture offset from the ideal focal point, but is still within the focal point zone of the dish reflector. The receive feedhorn is disposed at the ideal focal point for maximizing gain of received signals. A disadvantage with the Morley antenna is that the transmitter requires a relatively greater power output for compensating for the mispointing of the transmitted signal.

Consequently, what is needed is a small single antenna that is suitable for residential use, can simultaneously communicate with a geostationary FSS satellite and with a plurality of geostationary DBS satellites, and minimizes the amount of transmitters output power for transmitting to the FSS satellite.

SUMMARY OF THE INVENTION

The present invention provides a small single antenna that is suitable for residential use, can simultaneously communicate with a geostationary FSS satellite and with a plurality of geostationary DBS satellites, and minimizes the amount of transmitter output power for transmitting to the FSS satellite.

The advantages of the present invention are provided by an antenna that includes a reflector having a first axis, a second axis, a focal zone that is about parallel to the first axis, and a focal point located within the focal zone. According to the invention, a transmit feed is located at or about at the focal point, and at least one receive feed is located at about the focal zone. Preferably, the reflector is an elliptically-shaped offset-type parabolic reflector, and the transmit feed is part of a bidirectional feed that includes an integral receive feed. The bidirectional feed transmits and receives an RF signal carrying digital information signals to and from a first satellite, such as an FSS satellite, and each respective receive feed receives a signal from satellite, such as a DBS satellite.

In a preferred embodiment, the present invention provides an antenna that includes an elliptically-shaped offset-type parabolic reflector having a first axis, a second axis, a focal direction, a focal zone that is about parallel to the first axis, and a focal point located within the focal zone. Accordingly, a transmit feed is located within the focal zone, and at least one receive feed located at about the focal zone. A support arm extends from the bottom of the reflector in the focal direction of the reflector and supports the transmit feed at the focal point and each receive feed within the focal zone.

BRIEF DESCRIPTION OF THE DRAWING

The present invention is illustrated by way of example and not limitation in the accompanying figures in which like reference numerals indicate similar elements and in which.

DETAILED DESCRIPTION

Figure 1A:
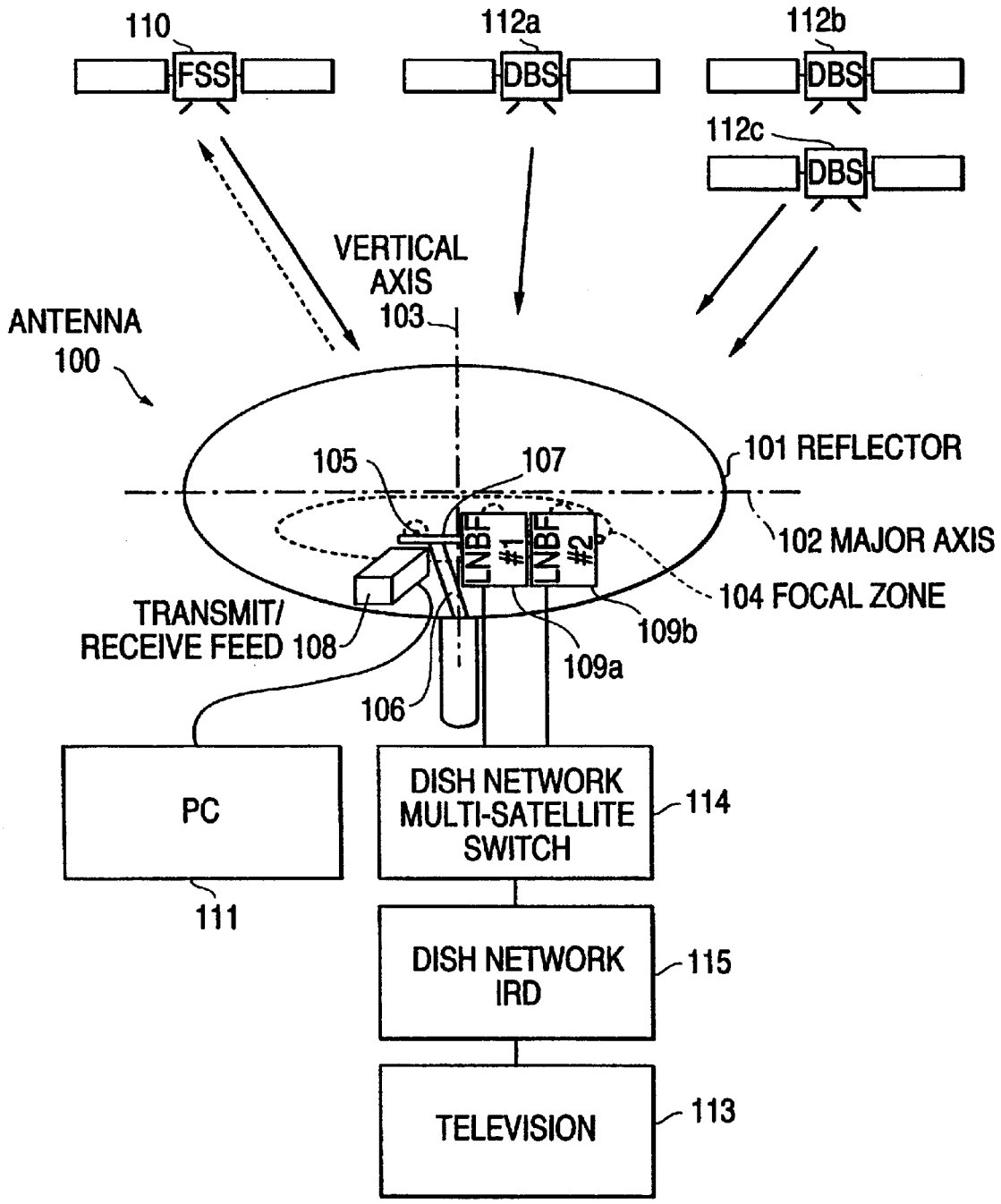
FIG. 1A shows a front view of a first configuration of an antenna according to the present invention.
Figure 2:
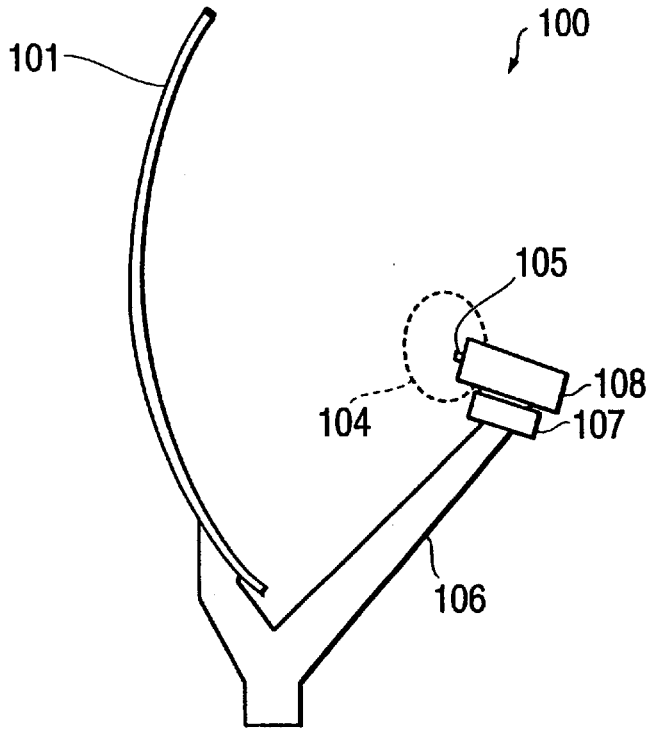
FIG. 2 shows a combination side/cross-sectional view of the first configuration of an antenna according to the present invention.
Figure 3:
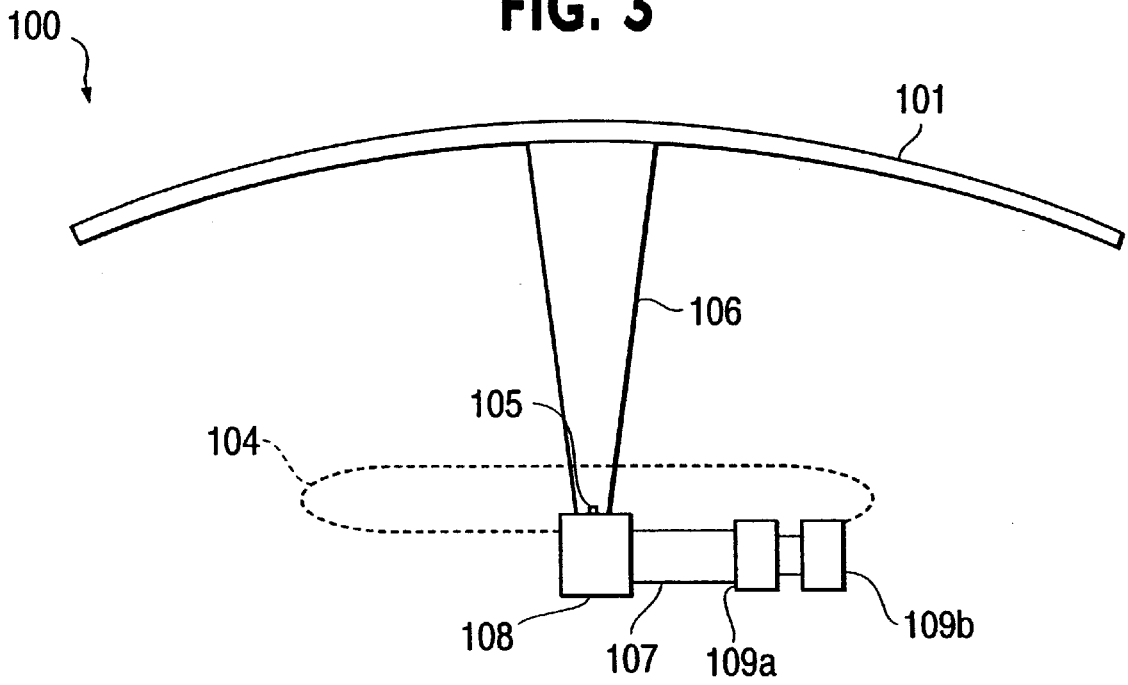
FIG. 3 shows a combination top/cross-sectional view of the first configuration of an antenna according to the present invention.
Figure 4:
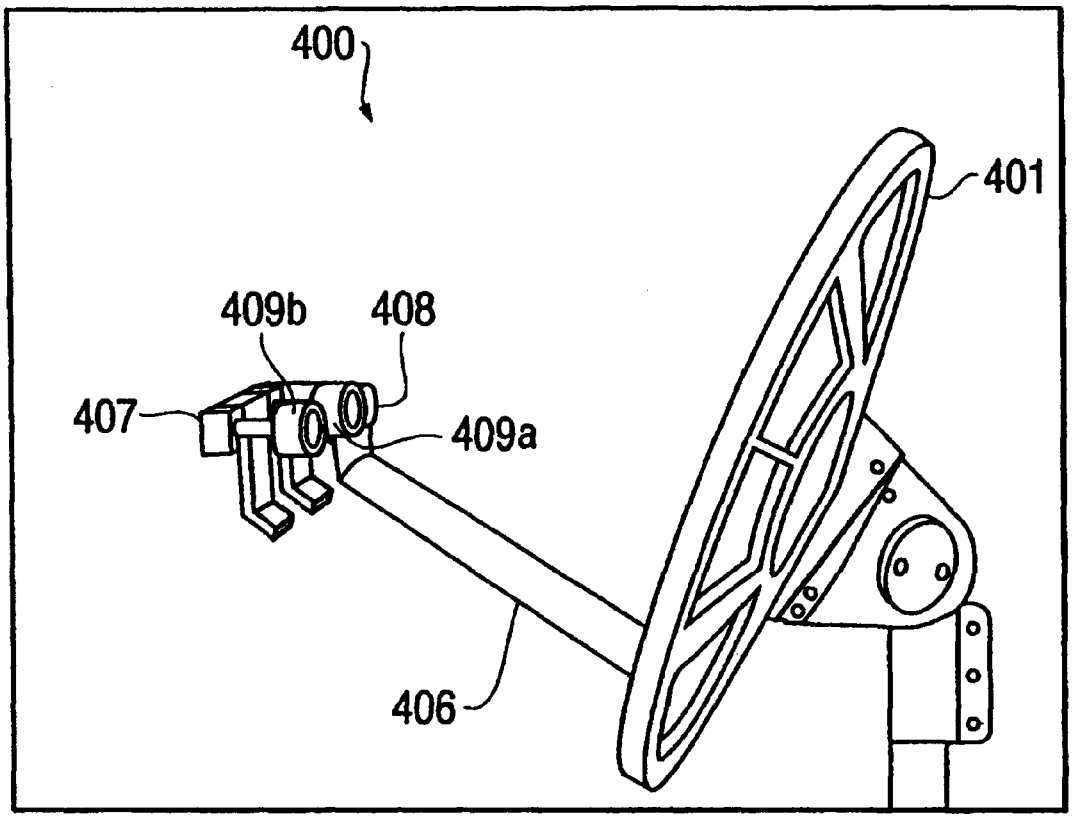
FIG. 4 shows a side perspective view of a preferred embodiment of an antenna according to the present invention.
Figure 5:
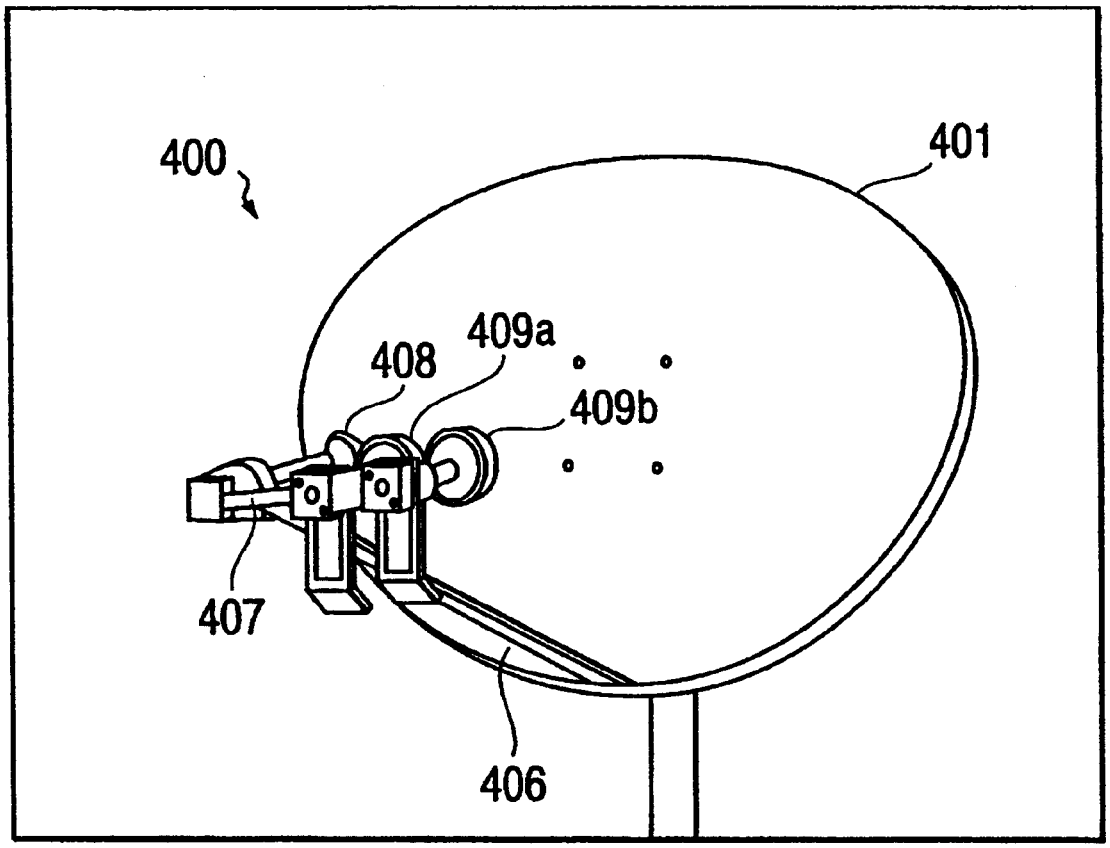
FIG. 5 shows a front perspective view of a preferred embodiment of an antenna according to the present invention.
Figure 6:
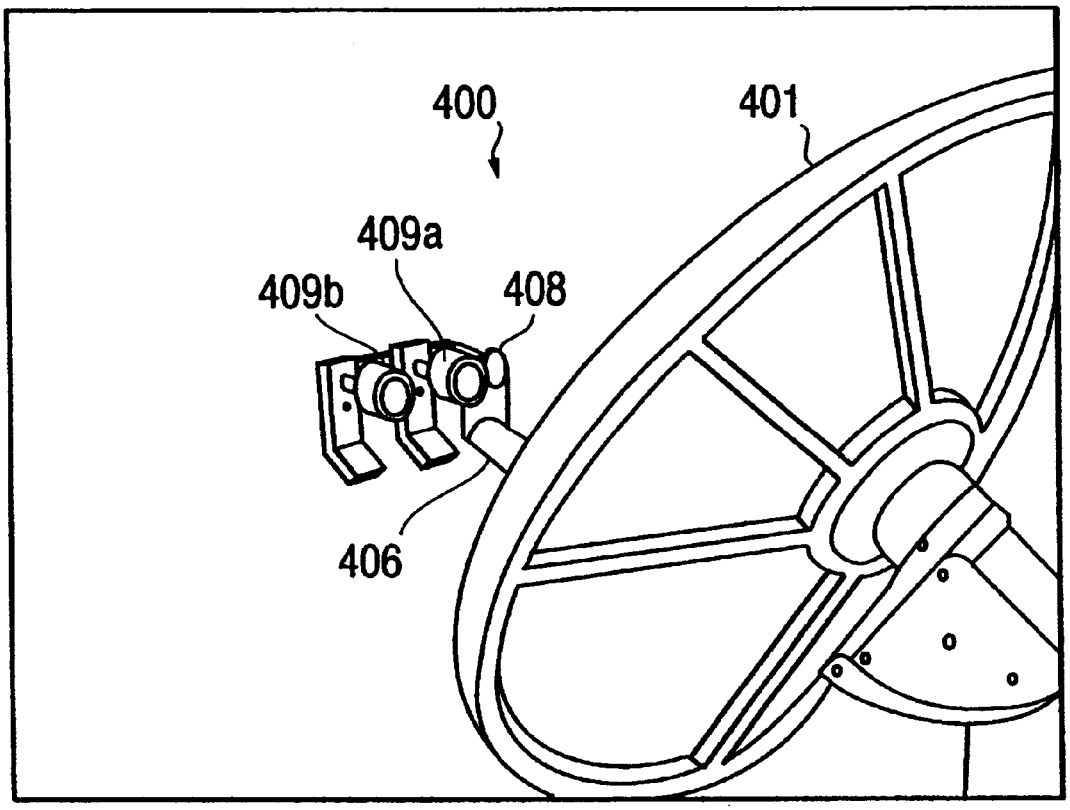
FIG. 6 shows a rear perspective view of a preferred embodiment of an antenna according to the present invention.
Figure 7:
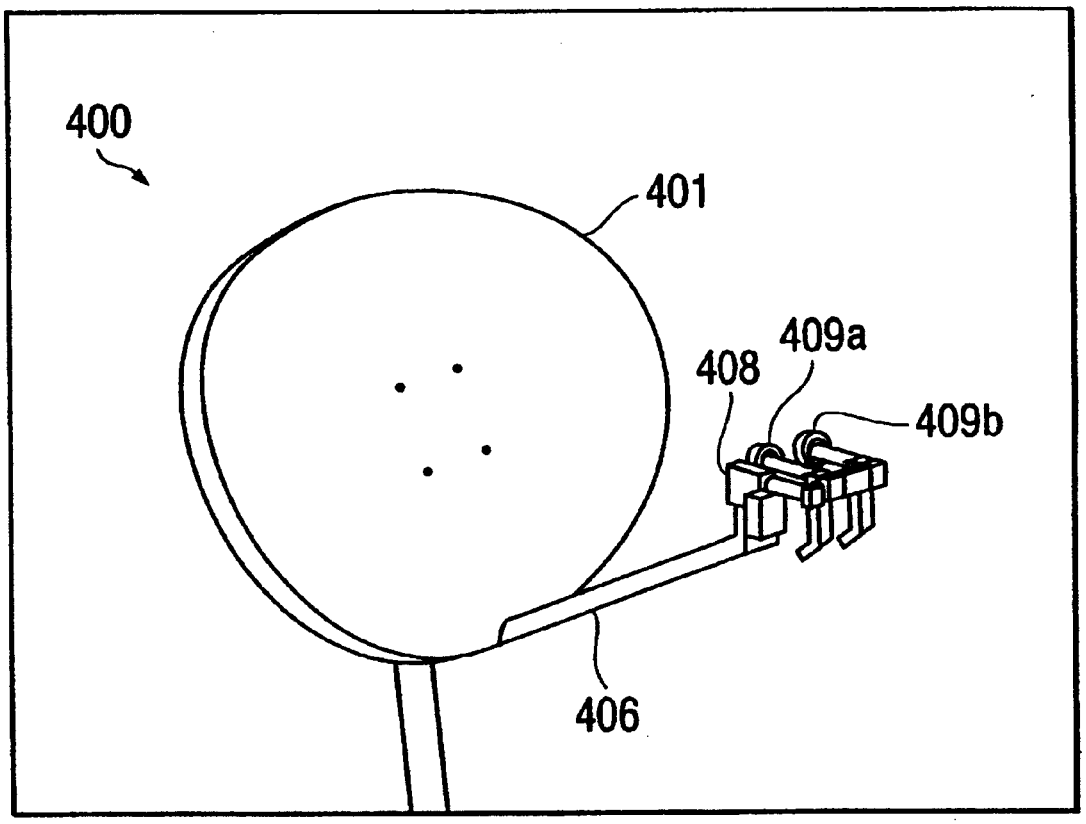
FIG. 7 shows another front perspective view of a preferred embodiment of an antenna according to the present invention.

FIG. 1 shows a front view of a first configuration of an antenna 100 according to the present invention. FIG. 2 shows a combination side/cross-sectional view of antenna 100. FIG. 3 shows a combination top/cross-sectional view of antenna 100.

As shown by FIGS. 1–3, antenna 100 includes a reflector 101 having a horizontal major axis 102 and a vertical minor axis 103. Preferably, reflector 101 is elliptically-shaped parabolic antenna so that a plurality of geostationary satellites are within the field of view of antenna 100. Also, reflector 101 is preferably an offset-type parabolic reflector for minimizing the field of view of reflector 101 that is blocked by feed and feed-support structures. The physical dimensions of reflector 101 are preferably 36.2 inches along major axis 102, and 26 inches along minor axis 103. The projected dimensions of antenna 100 are preferably 36.2 inches along major axis 102 and 24.6 inches along minor axis 103. The physical dimensions are the actual dimensions of the reflector 101, while the projected dimensions are the functional dimensions of the antenna, that is, the dimensions that a satellite "sees". The projected dimensions are a function of the shape and topography of the antenna.

Antenna 100 has a focal zone 104 (FIGS. 2 and 3) that parallel to horizontal major axis 102. When antenna 100 is oriented to communicate with the plurality of geostationary satellites, focal zone 104 is about parallel to the geostationary orbits (GSO) of the satellites, that is, focal zone 104 is about GSO parallel. Antenna 100 also has a focal point 105 that is defined by the shape of reflector 101.

A support arm 106 extends from the bottom of reflector 101. A feed-support member 107 extends from the end of support arm 106 substantially parallel to major axis 102. A transmit/receive feed 108 is mounted on feed support member 107 and is positioned at or about at focal point 105. Preferably, transmit/receive feed 108 is an integral bidirectional feed that transmits and receives an RF signal carrying digital information signals, such as used by computers for communicating between computers in a well-known manner. At least one additional receive feed 109 is positioned within focal zone 104. While the FIGS. 1–3 show two receive feeds, 109*a* and 109*b*, any number of additional receive feeds can be positioned within focal zone 104. Preferably, each receive feed 109 receives direct broadcast (DBS) television signals.

Figure 1B:
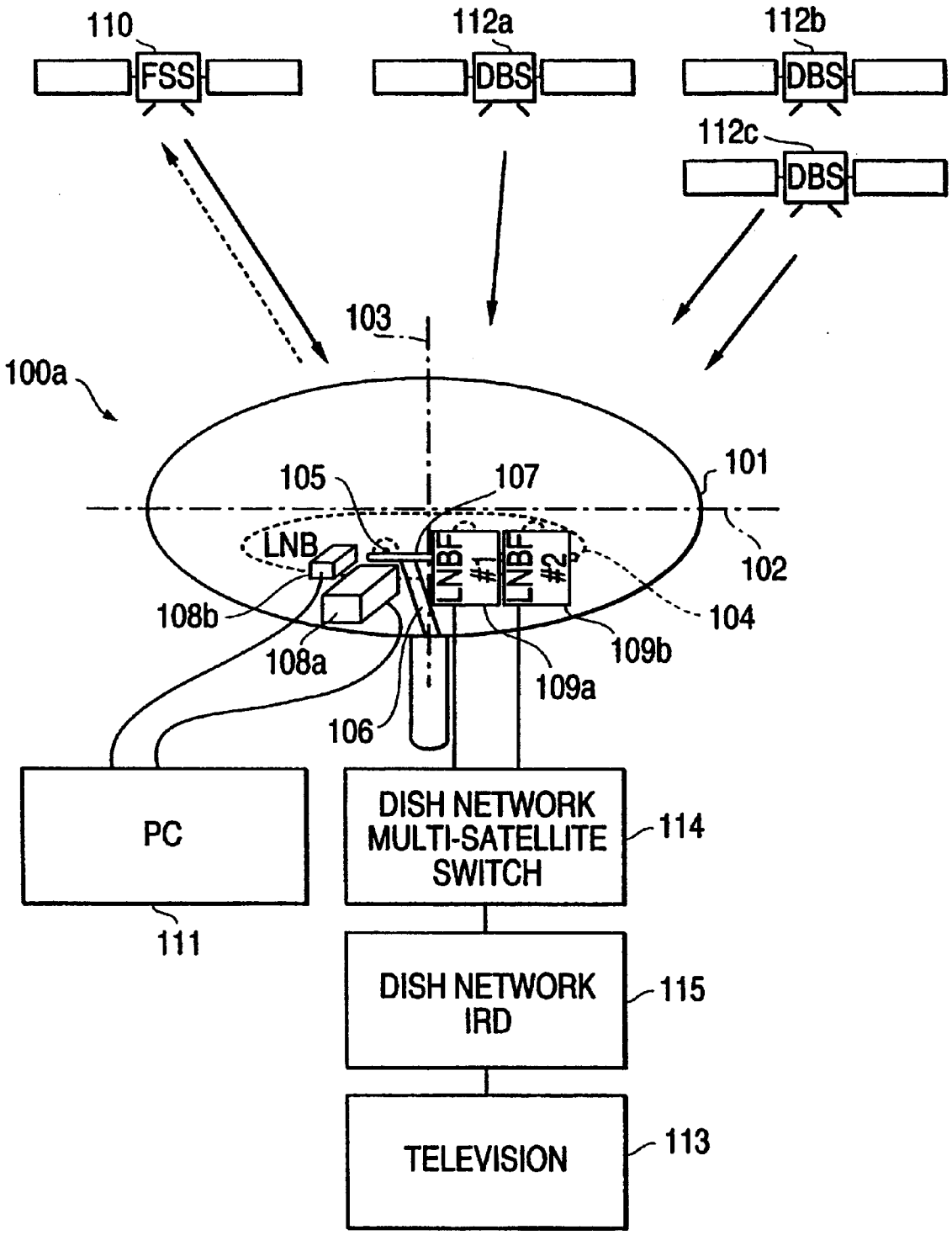
FIG. 1B shows a front view of an alternative configuration of an antenna according to the present invention.

FIG. 1B shows a front view of an alternative configuration of an antenna 100*a* according to the present invention. For this configuration, transmit/receive feed 108 can be used as a transmit/receive (Tx/Rx) feed and a receive-only (Rx) feed at the same time. Transmit/receive feed 108*a* is positioned at or about at focal point 105 together with receive feed 108*b*. Together transmit/receive feed 108*a* and receive feed 108*b* operate as a bidirectional feed that transmits and receives an RF signal carrying digital information signals, such as used by computers for communicating between computers in a well-known manner.

In operation, antenna 100 is oriented so that signals transmitted to and received from an FSS satellite are respectively transmitted and received from focal point 105, while signals received from each DBS satellite are respectively received at points within focal zone 104. More specifically, antenna 100 is oriented so that an FSS geostationary satellite 110, such as a Gstar 4 satellite, is focussed at focal point 105. Transmit/receive feed 108 is positioned on feed-support member 107 at or about at focal point 105 so that a signal transmitted to FSS geostationary satellite 110 is about optimized with respect to the pointing direction to the FSS satellite. Signals that are to be transmitted to FSS satellite 110 are generated by a computer system 111, such as a personal computer (PC), and converted in a well-known manner to an RF signal having an appropriate frequency for transmission to FSS satellite 110. Signals received from FSS satellite 110 are detected in a well-known manner and supplied to computer system 111.

Each additional receive feed 109 is positioned within focal zone 104 at a point that is about optimum for receiving a signal from a corresponding geostationary DBS (direct broadcast service) satellite 112 based on the pointing direction of antenna 100. Exemplary DBS satellites include the Echostar I and II system satellites and the Echostar IV system satellites. Signals received by additional receive feeds 109 are directed to a television 113 through, for example, a dish network multi-satellite switch 114 and a dish network integrated receiver/descrambler (IRD) 115.

FIGS. 4–7 show different views of a preferred embodiment of an antenna 400 according to the present invention. Antenna 400 includes an elliptically-shaped parabolic reflector 401. A support arm 406 extends from the bottom of reflector 401. A feed support member 407 extends from the end of support arm 406 substantially parallel to the major axis of reflector 401. A transmit/receive feed 408 is mounted on feed support member 407 and is positioned at or about at the focal point of reflector 401, as described above in connection with FIGS. 1–3. Transmit/receive feed 408 is an integral bidirectional feed that transmits and receives an RF signal carrying digital information signals. An additional receive feed 409 is positioned within the focal zone of reflector 401, as also described above. Both feeds 408 and 409 are mounted on support member 407 using an adjustment bracket 410 for optimizing each feed along a vertical direction.

In operation, antenna 400 is oriented so that signals transmitted to and received from an FSS satellite are respectively transmitted and received by transmit/receive feed 408, while signals received from a DBS satellite are respectively received by receive feeds 409*a* and 409*b*.

While the present invention has been described in connection with the illustrated embodiments, it will be appreciated and understood that modifications may be made without departing from the true spirit and scope of the invention.

What is claimed is:

1. An antenna, comprising:

a reflector having a focal zone and a focal point located within the focal zone;

a transmit feed located about at the focal point; and at least one receive feed located within the focal zone, wherein the transmit feed is part of a bidirectional feed, the bidirectional feed including a receive feed that is integral with the transmit feed and a separate transmit feed and a separate receive feed, the separate receive feed being located immediately adjacent to the separate transmit feed within the focal zone.

2. An antenna, comprising:

a reflector having a focal zone and a focal point located within the focal zone;

a transmit feed located about at the focal point; and at least one receive feed located within the focal zone, wherein the transmit feed is part of a bidirectional feed, the bidirectional feed transmits and receives an RF signal carrying digital information signals to and from a first satellite, and wherein each respective receive feed receives a DBS signal from satellite that is different from the first satellite.

3. An antenna, comprising:

a reflector having a focal direction, a focal zone and a focal point located within the focal zone;

a transmit feed located about at the focal point;

at least one receive feed located within the focal zone; and a support arm extending in the focal direction of the reflector and supporting the transmit feed at the focal point and each receive feed within the focal zone, wherein the transmit feed is part of a bidirectional feed, the bidirectional feed including a receive feed that is integral with the transmit feed, the bidirectional feed including a separate transmit feed and a separate receive feed, the separate receive feed being located immediately adjacent to the separate transmit feed within the focal zone.

4. An antenna, comprising:

a reflector having a focal direction, a focal zone and a focal point located within the focal zone;

a transmit feed located about at the focal point;

at least one receive feed located within the focal zone; and a support arm extending in the focal direction of the reflector and supporting the transmit feed at the focal point and each receive feed within the focal zone, wherein the transmit feed is part of a bidirectional feed, wherein the bidirectional feed transmits and receives an RF signal carrying digital information signals to and from a first satellite, and wherein each respective receive feed receives a DBS signal from satellite that is different from the first satellite.

5. A method comprising:

transmitting a signal to a satellite from a transmit feed of an antenna, the antenna including a reflector having a focal zone and a focal point located within the focal zone, the transmit feed being located about at the focal point; and receiving at least one signal from the satellite using at least one receive feed of the antenna, the receive feed being located within the focal zone, wherein the transmit feed is part of a bidirectional feed, said bidirectional feed including a receive feed that is integral with the transmit feed, the bidirectional feed including a separate transmit feed and a separate receive feed, the separate receive feed being located immediately adjacent the separate transmit feed within the focal zone.

6. A method comprising:

transmitting a signal to a satellite from a transmit feed of an antenna, the antenna including a reflector having a focal zone and a focal point located within the focal zone, the transmit feed being located about at the focal point; and receiving at least one signal from the satellite using at least one receive feed of the antenna, the receive feed being located within the focal zone, wherein the transmit feed is part of a bidirectional feed, said bidirectional feed including a receive feed that is integral with the transmit feed, further comprising:

transmitting and receiving an RF signal with the bidirectional feed, the RF signal carrying digital information signals to and from a first satellite, and receiving a DBS signal at each receive feed receives from a satellite that is different from the first satellite.

* * * * *